US007137347B2

(12) United States Patent
Wong et al.

(10) Patent No.: US 7,137,347 B2
(45) Date of Patent: Nov. 21, 2006

(54) STEER BY WIRE HELM

(75) Inventors: Ray Tat-Lung Wong, Richmond (CA); Colin Van Leeuwen, Vancouver (CA); Jon Scott, Vancouver (CA); Art Ferguson, Glenview, IL (US)

(73) Assignee: Teleflex Canada Incorporated, Richmond (CA)

( * ) Notice: Subject to any disclaimer, the term of this patent is extended or adjusted under 35 U.S.C. 154(b) by 0 days.

(21) Appl. No.: 10/926,327

(22) Filed: Aug. 26, 2004

(65) Prior Publication Data

US 2005/0229834 A1 Oct. 20, 2005

(30) Foreign Application Priority Data

Aug. 29, 2003 (CA) ..... 2438981

(51) Int. Cl.
*B63H 25/24* (2006.01)

(52) U.S. Cl. ..... 114/144 RE; 114/144 R

(58) Field of Classification Search ..... None
See application file for complete search history.

(56) References Cited

U.S. PATENT DOCUMENTS

| | | | | |
|---|---|---|---|---|
| 3,695,205 | A * | 10/1972 | Thomas | 114/144 R |
| 3,949,696 | A | 4/1976 | Onishi | |
| 4,120,258 | A * | 10/1978 | Spurgin | 114/144 E |
| 5,107,424 | A * | 4/1992 | Bird et al. | 701/21 |
| 6,250,418 | B1 | 6/2001 | Matsuoka | |
| 6,311,634 | B1 | 11/2001 | Ford | |
| 6,431,928 | B1 | 8/2002 | Aarnivuo | |
| 6,843,195 | B1 | 1/2005 | Watabe | |
| 2003/0033969 | A1 | 2/2003 | Doetsch | |

FOREIGN PATENT DOCUMENTS

| | | |
|---|---|---|
| CA | 2293850 | 6/2000 |
| EP | 1253061 | 10/2002 |
| WO | WO 02/40336 | 5/2002 |
| WO | WO 02/102616 | 12/2002 |
| WO | WO 02/102640 | 12/2002 |

* cited by examiner

*Primary Examiner*—Sherman Basinger
(74) *Attorney, Agent, or Firm*—Baker & Hostetler LLP

(57) ABSTRACT

A helm apparatus for a marine craft or other vehicle having a steered member such as a rudder includes a mechanically rotatable steering device and a sensor which senses angular movement of the steering device when the craft is steered. A communication link to the rudder enables the helm to monitor the rudder position. A bi-directional stop mechanism is actuated when the helm determines that the rudder position is beyond starboard or port hard-over thresholds, indicating that the rudder has reached a limit of travel. The helm can cause the stop mechanism to fully engage the steering device to stop further rotation of the steering device in a first rotational direction, corresponding to rotational movement towards the limit of travel.

53 Claims, 9 Drawing Sheets

STEER BY WIRE HELM

BACKGROUND OF THE INVENTION

This invention relates to steering systems and, in particular, to steer-by-wire steering systems for marine craft or other vehicles.

Conventional marine steering systems couple one or more helms to one or more rudders utilizing mechanical or hydraulic means. In smaller marine craft, cables conventionally have been used to operatively connect a helm to the rudder. Alternatively the helm has been provided with a manual hydraulic pump operated by rotation of the steering wheel. Hydraulic lines connect the helm pump to a hydraulic actuator connected to the rudder. Some marine steering systems provide a power assist via an engine driven hydraulic pump, similar to the hydraulic power steering systems found in automobiles. In those systems a cable helm or a hydraulic helm mechanically controls the valve of a hydraulic assist cylinder.

It has been recognized that so-called steer-by-wire steering systems potentially offer significant advantages for marine applications. Such systems may yield reduced costs, potentially more reliable operation, more responsive steering, greater tailored steering comfort, and simplified installation. Smart helms allow an original equipment manufacturer (OEM) to tailor steering feel and response to craft type and operator demographics. Steer-by-wire steering systems are also better adapted for modern marine craft fitted with CAN buses or similar communications buses and may make use of electrical information from speed, load and navigation, autopilot or anti-theft devices for example.

Various attempts have been made to provide a commercially viable steer-by-wire steering system for marine craft. An example is found in U.S. Pat. No. 6,273,771 to Buckley et al. which utilizes a CAN bus for a plurality of helms. Another is found in U.S. Pat. No. 5,107,424 to Bird et al. A further example is found in U.S. Pat. No. 6,311,634 to Ford et al.

However these earlier systems have not been completely successful in replacing more conventional hydraulic steering systems in smaller marine craft for example. Accordingly there is a need for an improved steer-by-wire steering system particularly adapted for smaller marine craft and also potentially useful for other steering applications such as tractors, forklifts and automobiles.

SUMMARY OF THE INVENTION

According to an embodiment of the invention, there is provided a helm apparatus for a marine craft or other vehicle having a steer member such as a rudder. The apparatus includes a mechanically rotatable steering device and a sensor which senses angular movement of the steering device when the craft is steered. A stop mechanism is actuated when the rudder position reaches a starboard or port threshold position, near a starboard or port hard-over position. The stop mechanism then engages the steering device to stop further rotation of the steering device in a first rotational direction, corresponding to rotational movement towards said hard-over position. A degree of rotational play is provided between the steering device and the stop mechanism, whereby the steering device can be rotated a limited amount, as sensed by the sensor, when the stop mechanism is fully engaged. The stop mechanism is released from engagement with the steering device when the sensor senses that the steering device is rotated, as permitted by said play, in a second rotational direction, which is opposite the first rotational direction.

The same stop mechanism, or an optional steering effort mechanism, can be used to provide a dynamic steering effort, whereby the torque required to rotate the steering shaft is varied based on system inputs and configurations. The required torque is changed by fluctuations of the amount of friction between the steering effort mechanism and the steering shaft, based on system inputs and configurations. Additionally, it is understood that multiple sensors can replace the single sensor used for sensing angular rotation of the steering shaft. These sensors can be used to validate each other's information for greater accuracy and provide fault detection and recovery.

According to another embodiment of the invention there is provided a steering apparatus for a marine craft having a rudder. The apparatus comprises a rotatable wheel and an encoder responsive to angular movement of the wheel which provides helm signals indicative of incremental movement of the wheel. There is a stop mechanism capable of selectively stopping rotation of the wheel. A processor adjacent to the stop mechanism is coupled to the encoder and receives the helm signals and rudder signals indicative of positions of the rudder. The processor provides a stop signal to actuate the stop mechanism and stop rotation of the wheel when the rudder approaches a predetermined limit of travel.

According to another embodiment of the invention there is provided a method of stopping rotation of a steering wheel of a vessel having a rudder, near hard-over positions of the rudder. The method comprises producing rudder signals indicating rudder positions, receiving the rudder signals near the steering wheel and determining whether the rudder positions are within a predetermined distance of hard-over positions of the rudder. A stop mechanism operatively coupled to the steering wheel is engaged if the steering wheel is rotated in a direction corresponding to rudder movement towards said hard-over positions. The stop mechanism is released if the steering wheel is rotated in a direction corresponding to rudder movement away from said hard-over positions.

There are significant advantages and distinctions between the present invention and the prior art, particularly U.S. Pat. No. 6,311,634 to Ford et al. (Nautamatic) as follows:

- The Nautamatic helm stop is uni-directional, while helm stops according to the invention may be bi-directional;
- The Nautamatic device needs two stop mechanisms but helm stops according to the invention needs only one;
- The Nautamatic system does not use a processor with a bus in the helm so it is not convenient to connect multiple helms to one or more actuators;
- A possible mechanical failure mode of the Nautamatic stop is that it may become locked due to jamming of the sprag mechanism and this is not possible with helm stops according to the invention;
- Helms according to the invention integrate into a multi-helm system more easily (the helm, instead of the rudder, has control of helm hardware);
- Mechanical stop failure modes, with helm stops according to the invention, are less severe (a multi-disk stop will not jam);
- A helm according to the invention, not the rudder, has control over the stop device which gives assurance of latency for activation/deactivation, especially in a multi-helm situation; and
- Helm position change signals in helms according to the invention are sent over a CAN bus by the helm processor rather than being read directly by the rudder processor and this is more resistant to noise than directly sending the helm position signal to the rudder.

DETAILED DESCRIPTIONS OF THE PREFERRED EMBODIMENTS

Figure 1:
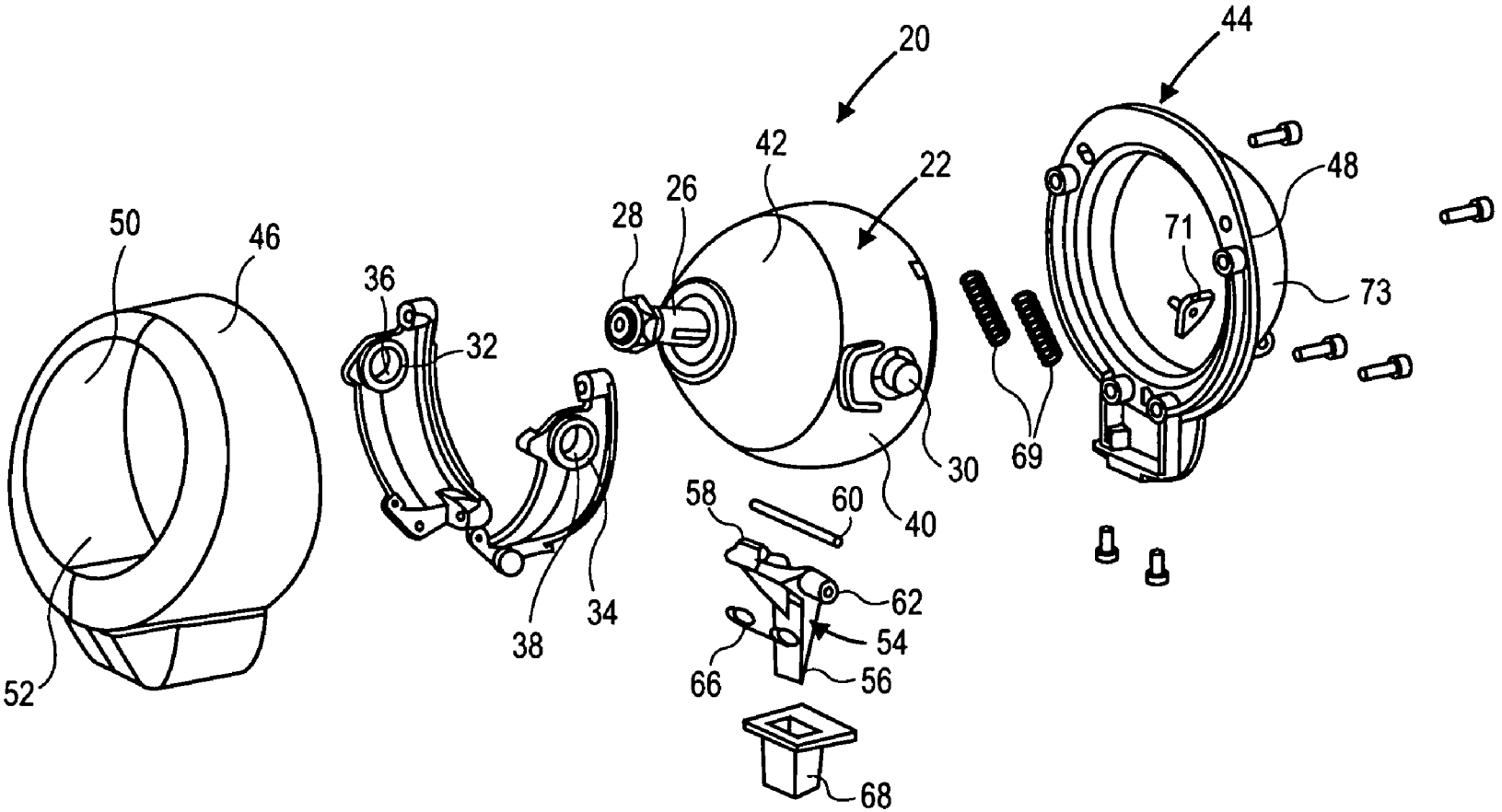
FIG. 1 is an isometric view, partially exploded, of a helm apparatus according to a first embodiment of the invention.
Figure 2A:
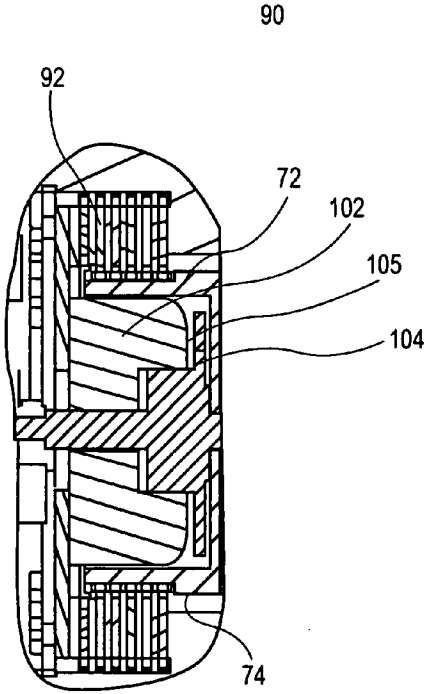
FIG. 2*a* is an enlarged, fragmentary sectional view showing the stop mechanism of FIG. 2.
Figure 2:
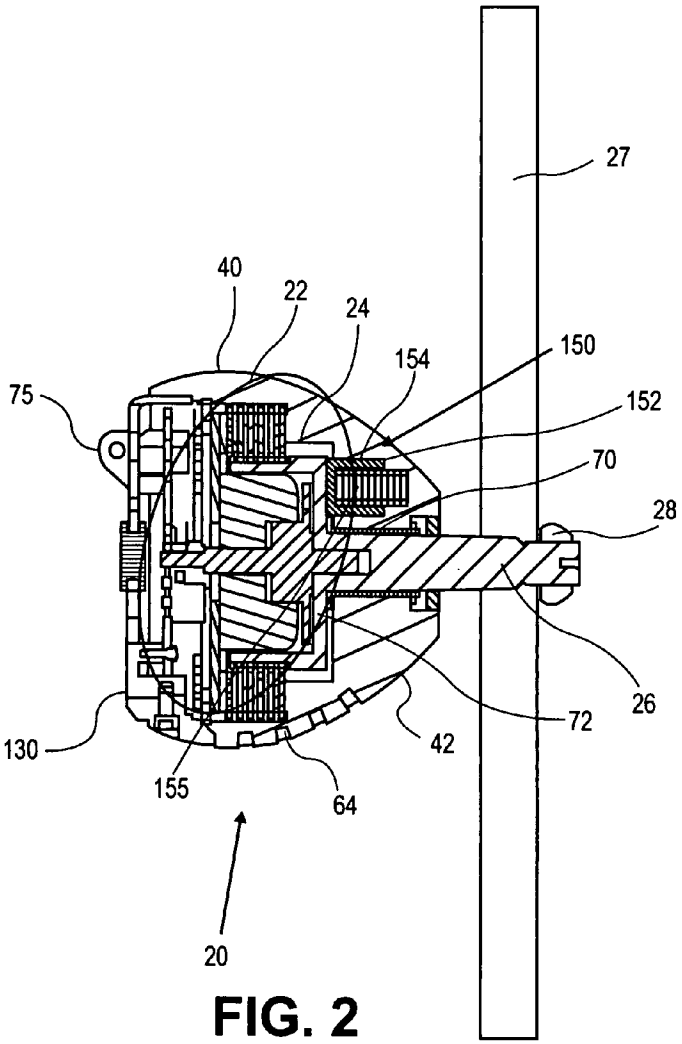
FIG. 2 is a sectional view thereof.
Figure 8:
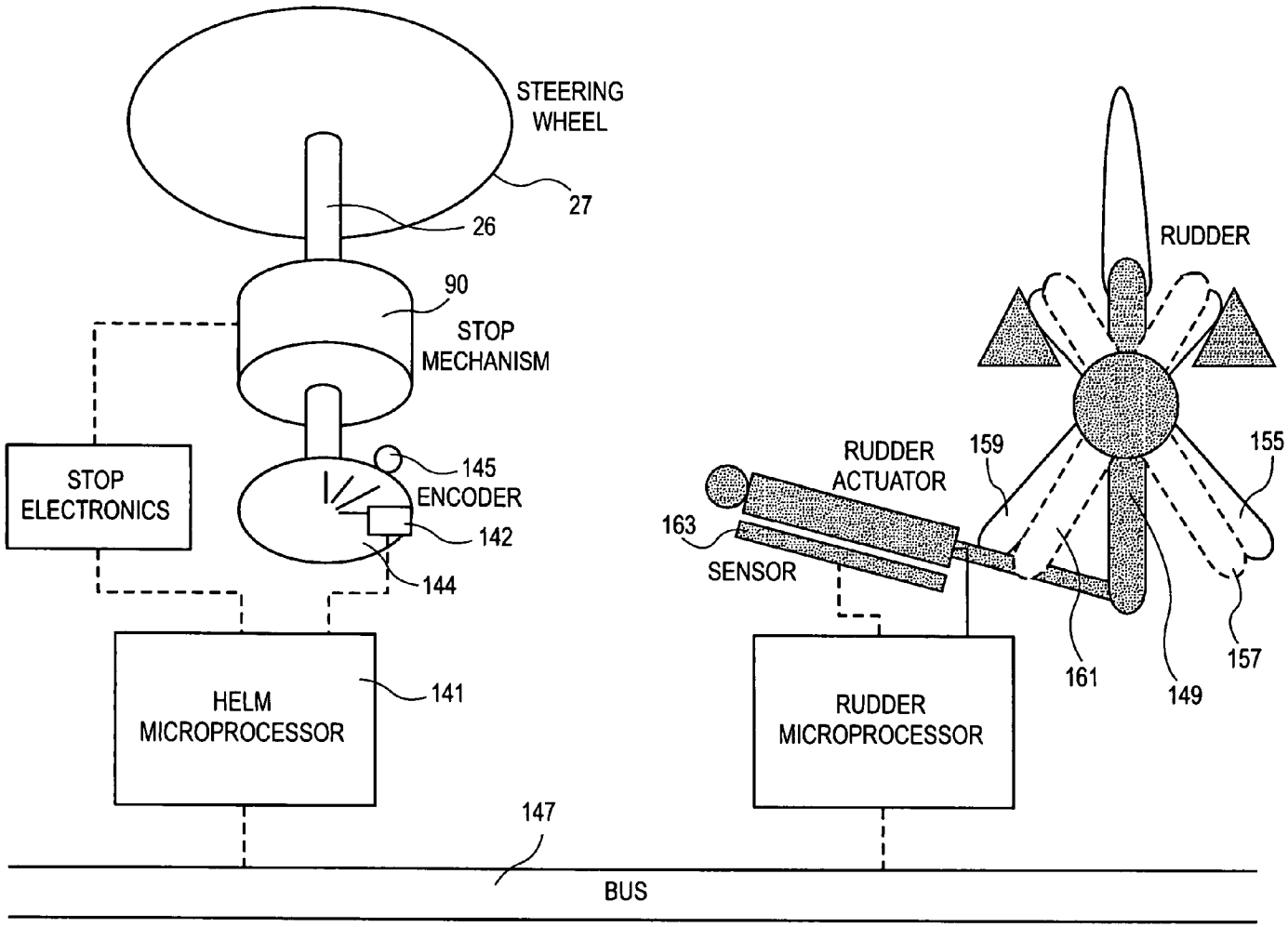
FIG. 8 is diagrammatic view of a smart helm system according to an embodiment of the invention.

Referring to the drawings, FIGS. 1 and 2 show a helm apparatus 20 according to a first embodiment of the invention. The apparatus includes a pivotable housing 22 having a hollow interior 24, shown in FIG. 2, containing most of the functional components described below. Steering shaft 26 extends into the housing. The steering wheel 27, shown in FIGS. 2 and 8, is mounted on the steering shaft by means of nut 28. The housing has a pair of trunnions 30, only one of which is shown, the other being on the opposite side of the housing. The housing is pivotably mounted on a pair of trunnion mounts 32 and 34 having bearings 36 and 38 respectively for rotatably receiving the trunnions.

The housing has an outer surface including a partially spherical portion 40 and a convexly curved, tapering portion 42 extending between portion 40 and the steering shaft 26. A mounting plate 44, having a cover 46 with an inner portion 50, is fitted over the housing and the trunnion mounts. The mounting plate includes a partially spherical, concave surface 48 which prevents water from splashing, or rain from leaking into, the back of the dashboard of the vessel. Portion 42 of the housing extends through aperture 52 in cover 46 of the mounting plate.

There is a lock member 54 having a lever 56 and a latch 58 pivotally mounted inside the trunnion mounts by means of axle 60 which fits through bore 62 in the lock member and bores 61 and 63 in the trunnion mounts 32 and 34 respectively. The housing has a series of slots 64, five in this particular example as shown in FIG. 2, which can selectively receive latch 58 of the lock member. A coil spring 66, anchored on each end to the trunnion mounts, biases the lock member so the latch tends to engage one of the slots 64. By pushing the lever 56 to the right, from the point of view of FIG. 1, the latch is released from the slots. This allows the housing to be rotated about the trunnion mounts and relative to the mounting plate to achieve the desired tilt of the steering wheel. When this is achieved, the lever 56 is released so that the latch 58 engages the closest slot 64. A rubber boot 68 is fitted to the mounting plate about the lever 56 to provide a soft lever feel and acts as a guard. Coil springs 69, shown disconnected in FIG. 1, are connected to lug 71 of rear cover 73, as well as a second such lug not shown, and to lug 75 on cover 130, shown in FIG. 2, as well as a second such lug not shown, to bias the housing clockwise from the point of view of FIG. 1. It is to be understood that the tilt is optional, for example the associated hardware is not required for non-tilting or rear-mount helms.

Figure 3:
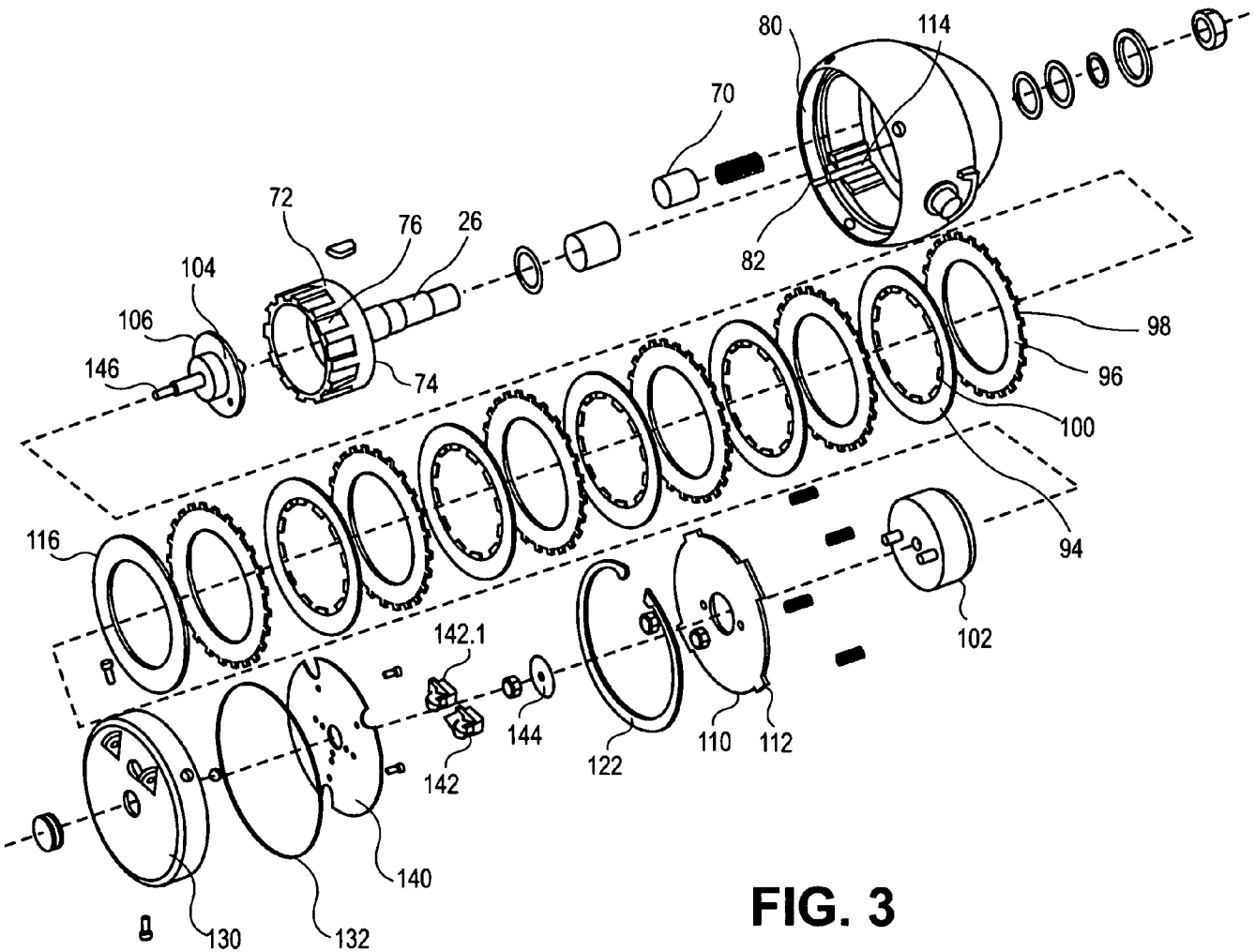
FIG. 3 is an exploded view of the helm apparatus according to the first embodiment of the invention.

A bearing 70 within the housing 22 rotatably supports steering shaft 26 as shown in FIGS. 2 and 3. The steering shaft has a hollow drum 72 with an outer cylindrical surface 74. Outer cylindrical surface 74 has a plurality of circumferentially spaced-apart, axially extending grooves 76. Inner surface 80 of the housing also has a plurality of the spaced-apart, axially extending slots 114.

The apparatus includes a stop mechanism, shown generally at 90 in FIG. 2*a*, which includes a multi-plate clutch 92 having a plurality of clutch plates 94 and 96 as shown in FIG. 3. Two types of plates are employed. There is a total of five plates similar to plate 94 which alternate with six plates similar to plate 96. It should be understood that the exact number of plates could vary in other embodiments. The plates are annular in shape in this example as shown in FIG. 3. The plates 96 have exterior projections or splines 98 which correspond in position with the slots 114 in the housing such that these plates are axially slidable, but non-rotationally received within the housing. The plates 94 have interior projections or splines 100 which correspond in number and position with the grooves 76 on the steering shaft. Thus the plates 94 are axially slidable with respect to the steering shaft. However a relatively limited amount of rotational movement is permitted between the plates 94 and the steering shaft because the slots 76 are wider than the splines 100. It should be understood that this relatively limited amount of rotational movement can be made between plates 96 and slots 114 in the housing with the same arrangement.

The stop mechanism includes an actuator, an electromagnetic actuator 102 in this example, in the form of a solenoid with an armature 104. The armature is provided with a shaft 106 which is press fitted to connect the armature to the inside of drum 72 of the shaft 26. Accordingly the armature is rigidly connected to the steering shaft. Alternatively, armature 104 and drum 74 can be made as one piece.

The solenoid is mounted on a circular plate 110 having external projections or splines 112 which are received in slots 114 inside the housing. The fit between the splines and the slots is tight so that no rotational movement is permitted between the housing and the solenoid. An annular shim 116 is received between the solenoid and the clutch plates. This is used to adjust clearance between the armature and solenoid, which is variable due to tolerances in the plates 94 and 96. A retaining ring 122 secures the stop mechanism together. When the solenoid is energized, the solenoid and plate 110 are drawn towards the armature to force the plates 94 and 96 together. Since the plates 96 are non-rotatable with respect to the housing, and plates 94 are non-rotatable with respect to the steering shaft, apart from the play discussed above, friction between the plates, when the solenoid is energized, causes the stop mechanism to stop rotation of the steering shaft relative to the housing.

The cover 130 of the housing is equipped with an o-ring 132 to seal the housing at surface 82. A circuit board 140 is fitted between the cover and the retaining ring 122. A microprocessor 141, shown in FIG. 8, is mounted on the circuit board along with rotational sensors 142 and 142.1. An encoder disk 144 is received on shaft 146 of the armature which rotates with the steering shaft. The sensors detect rotation of the encoder disk and, accordingly, rotation of the steering shaft and steering wheel. It is understood that the encoder disk may be connected via gears to increase resolution. In this example an LED light source 145, shown in FIG. 8, is used. The disk 144 has a plurality of slots and the sensors are light sensitive. Other arrangements are possible such as a reflective disk or a Hall effect sensor and a magnetic disk.

Figure 4:
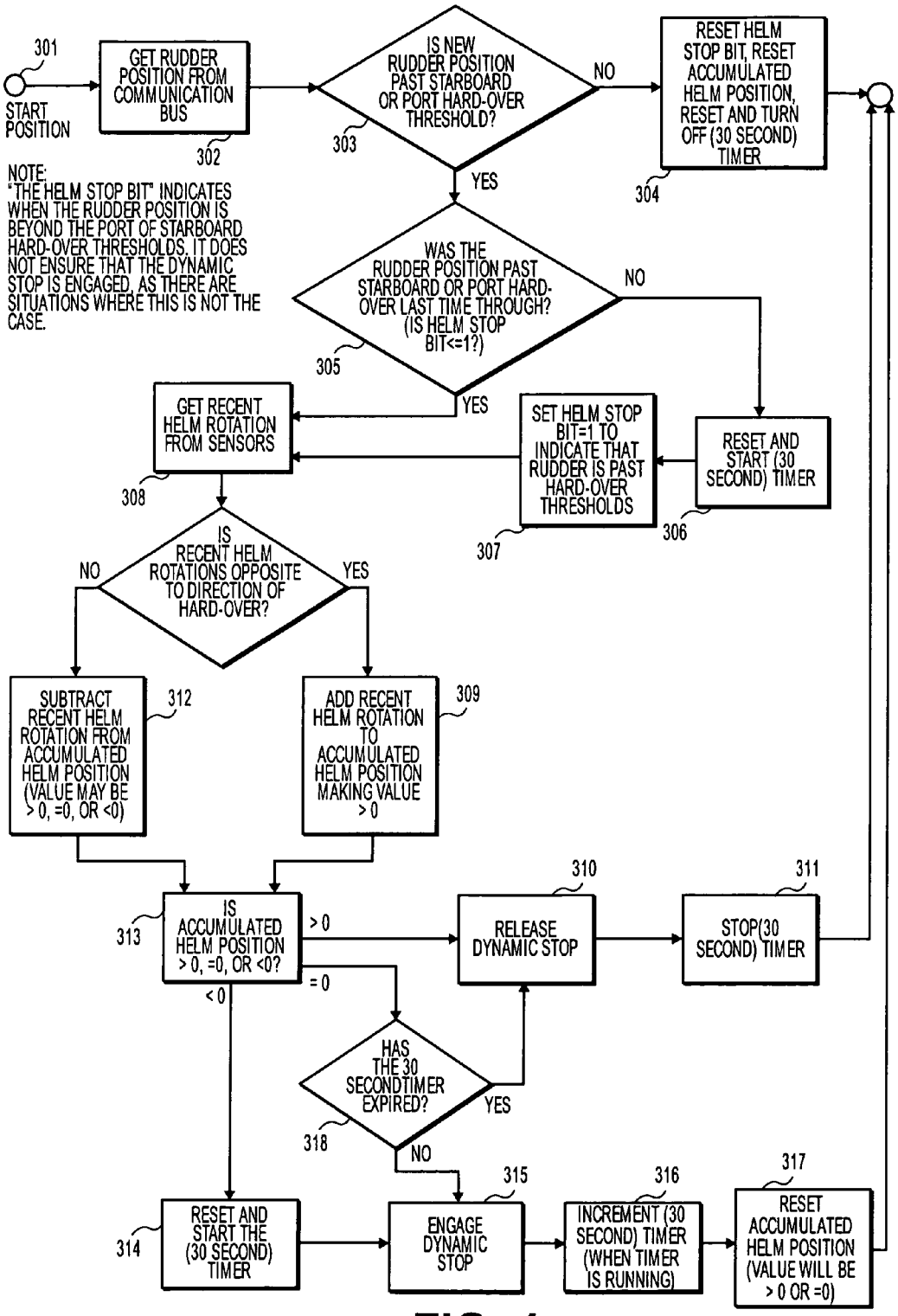
FIG. 4 is a flowchart of the software utilized by the microprocessor for the stop mechanism control in FIGS. 1–3.

FIG. 4 is a flowchart showing how the microprocessor controls the dynamic stop. The helm has predetermined starboard and port hard-over thresholds. In summary, when the rudder position from rudder 149, shown in FIG. 8, is received by the helm processor 141 has breached the threshold, as indicated by the updated helm stop bit, then an accumulated helm position is retained in the microprocessor. The helm sensors are then polled for recent helm rotation. If the recent helm rotation is opposite to the direction of the hard-over, then the stop mechanism is released and the recent helm rotation is added to the accumulated helm position. If the rotation is in the same direction as hard-over, or if there is no rotation at all, then the value of recent helm rotation is subtracted from the accumulated helm position. If the accumulated helm position is >0, then the stop mechanism is released. However, if the helm position is =0 or <0, then the stop mechanism is engaged and the accumulated helm position is reset to 0.

There is a timer which is reset and started each time the stop mechanism is first engaged. The stop mechanism is released after the timer expires (i.e. after 30 seconds have gone by) whether or not the craft is steered away from the hard-over position. This is designed to increase the life-expectancy of the stop mechanism and decrease power consumption. It should be understood that this timer feature is optional and the time period of 30 seconds could be changed or omitted entirely.

Referring to the flowchart of FIG. 4 in more detail, commencing with the start position at 301, the helm processor first updates the rudder position information from the communication bus at 302, in this example a CAN bus 147, shown in FIG. 8, and determines at 303 if this position is beyond the starboard or port hard-over thresholds. In this embodiment the signals from the rudder define the rudder position in the form of integers using the range 0–4000. Numbers less than or equal to 200 indicate that the port threshold has been breached, while numbers greater than or equal to 3800 indicate that the starboard threshold has been breached. FIG. 8 shows rudder 149, its starboard hard-over position 155, its starboard threshold 157, its port hard-over position 159 and its port threshold 161. The rudder processor uses sensor 163 to determine the rudder position and communicate with CAN bus 147 as shown in FIG. 8.

If neither threshold has been breached, then the helm stop bit is reset, the accumulated helm position is reset to zero, the timer is reset and stopped at 304, and the stop mechanism is released. If the rudder position is beyond a threshold, then the processor determines if this is a new situation at 305 (i.e. if the previous rudder position was not beyond the threshold, the helm stop bit would be zero). If this is a new situation (being beyond the threshold), then the timer is reset at 306 and started and the helm stop bit is set to 1 at 307.

If the rudder position is past either of the hard-over thresholds, and the helm stop bit has now been set, the processor then retrieves recent helm rotation information from the helm sensors at 308. If the recent helm rotation is opposite to the hard-over position, in other words if the operator steers away from the hard-over position, then the recent helm rotation is added to the accumulated helm position at 309, making this value greater than zero. The dynamic stop is then released at 310 and the timer is stopped at 311.

If, however, the operator steers towards the hard-over position or there is no recent helm rotation at all, then the value of recent helm rotation is subtracted from the accumulated helm position at 312 (making this value greater than, less than or equal to zero). Three cases follow at 313.

If the accumulated helm position is greater than zero, then the dynamic stop is released at 310 and the timer is stopped at 311.

If the accumulated helm position is less then zero, then the timer is reset and started at 314, the dynamic stop is engaged at 315, the timer is incremented at 316 and the accumulated helm rotation is reset to zero at 317.

If the accumulated helm position is equal to zero, then the processor ascertains if the timer has expired at 318 (i.e. exceeded the value representative of 30 seconds). If the timer has expired, then the dynamic stop is released at 310 and the timer is stopped at 311. If the timer has not expired then the dynamic stop is engaged at 315, the timer is incremented at 316, and the accumulated helm rotation is reset to zero at 317.

Referring back to FIG. 2, there is a steering effort device 150 including a piston-like member 152 slidingly received in a cylinder 154 in the housing 22. A coil spring 155 biases the member 152 against drum 72 of the steering shaft. This provides a degree of steering effort so that the operator will get the sensation of some resistance when steering the craft. The steering effort device 150 can also mask the freeplay between the steering shaft 26 and steering stop 90 to provide the operator with a smooth-feeling transition when steering direction is changed. The steering effort device also increases vibration resistance against unintentional rotation of the steering shaft.

In a preferred embodiment of the invention, however, dynamic steering effort is provided. This is accomplished by partially applying the solenoid 102 to cause some friction between the plates 94 and 96, but not sufficient to stop the steering shaft from turning. In one example this is done by pulse width modulation of the current supplied to the solenoid as controlled by the microprocessor 141 shown in FIG. 8. In short, the dynamic steering device utilizes the same components as the steering stop described above, but a different type of control.

The amount of effort can be adjusted for different circumstances. For example, when the helm is rotated too fast or the rudder actuator is heavily loaded, in either case preventing the rudder from keeping up with the helm, the steering effort can be made greater to provide feedback to the operator, slowing down the rate of helm rotation. The effort can be made greater at higher speeds and lower at low speeds as encountered during docking. Also higher effort can be used to indicate that the battery charge is low to discourage fast or unnecessary movements of the helm. Also the effort can be made greater to provide a proactive safety feature for non-safety critical failures. By imposing a slight discomfort to the operator, this intuitive sensation feedback alerts the operator that the steering system behaves in a "reduced performance steering mode," encouraging the operator to slow down the boat or return to dock.

To provide continuous variable and consistent steering effort, it is desirable, but not necessary, to measure the solenoid gap 105 shown in FIG. 2*a*. The solenoid force is inversely proportional to the square of solenoid gap and the steering effort is proportional to the solenoid force with the stop mechanism described above. The measured solenoid gap can be used as feedback to the processor to compensate for steering effort change due to long-term effects, such as mechanical wear or creep. The solenoid gap can be measured indirectly or directly.

One example of measuring solenoid gap indirectly is by measuring inductance change in the coil. The inductance is proportional to the solenoid gap. By measuring the ripple in pulse width modulation, with coil resistance being known by measuring current through the coil, the inductance can be estimated.

$$T=L/R$$

where

T is the ripple time constant (the time it takes to change);

L is the inductance of the solenoid; and

R is the resistance of the solenoid.

The solenoid gap is proportional to the inverse of the inductance:

gap $\alpha$ 1/L; and

F $\alpha$ $1/gap^2$ where F is the solenoid force.

Accordingly, the solenoid force can be determined without any additional hardware. Also the steering torque can be determined from the solenoid force as follows:

$$\text{Steering Torque}=N.R_{mean}.F_{axial}.\mu$$

where:

N is the number of friction surfaces;

$R_{mean}$ is the mean radius of the disk;

$F_{axial}$ is the axial force; and $\mu$ is the coefficient of friction.

Figure 7A:
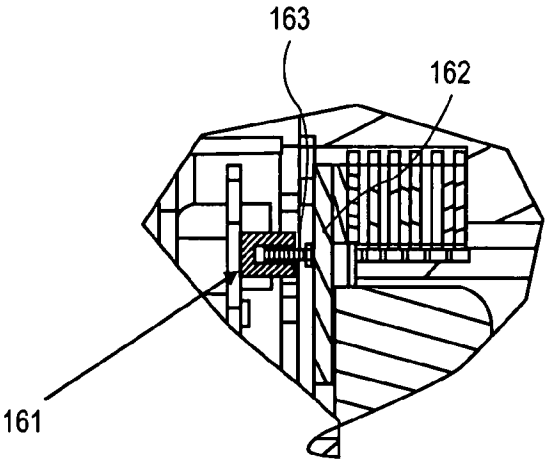
FIG. 7*a* is an enlarged, fragmentary view showing the proximity sensor thereof.
Figure 7:
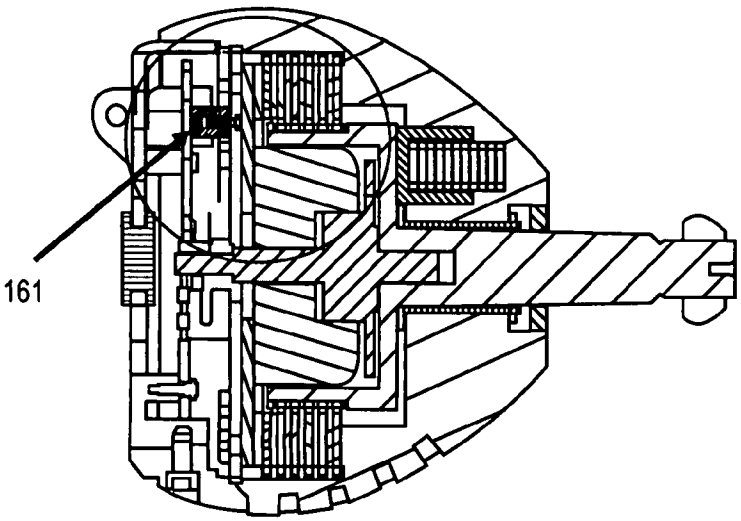
FIG. 7 is a sectional view similar to FIG. 6, showing an alternative embodiment with a proximity sensor.

Another example of measuring solenoid gap directly is by using a proximity sensor 161 as shown in FIG. 7. The proximity sensor 161 measures the gap 163 between disk back plate 162 and proximity sensor 161. Since the circuit board is right beside the back plate, a low-cost circuit board mount proximity sensor can be used.

Figure 9:
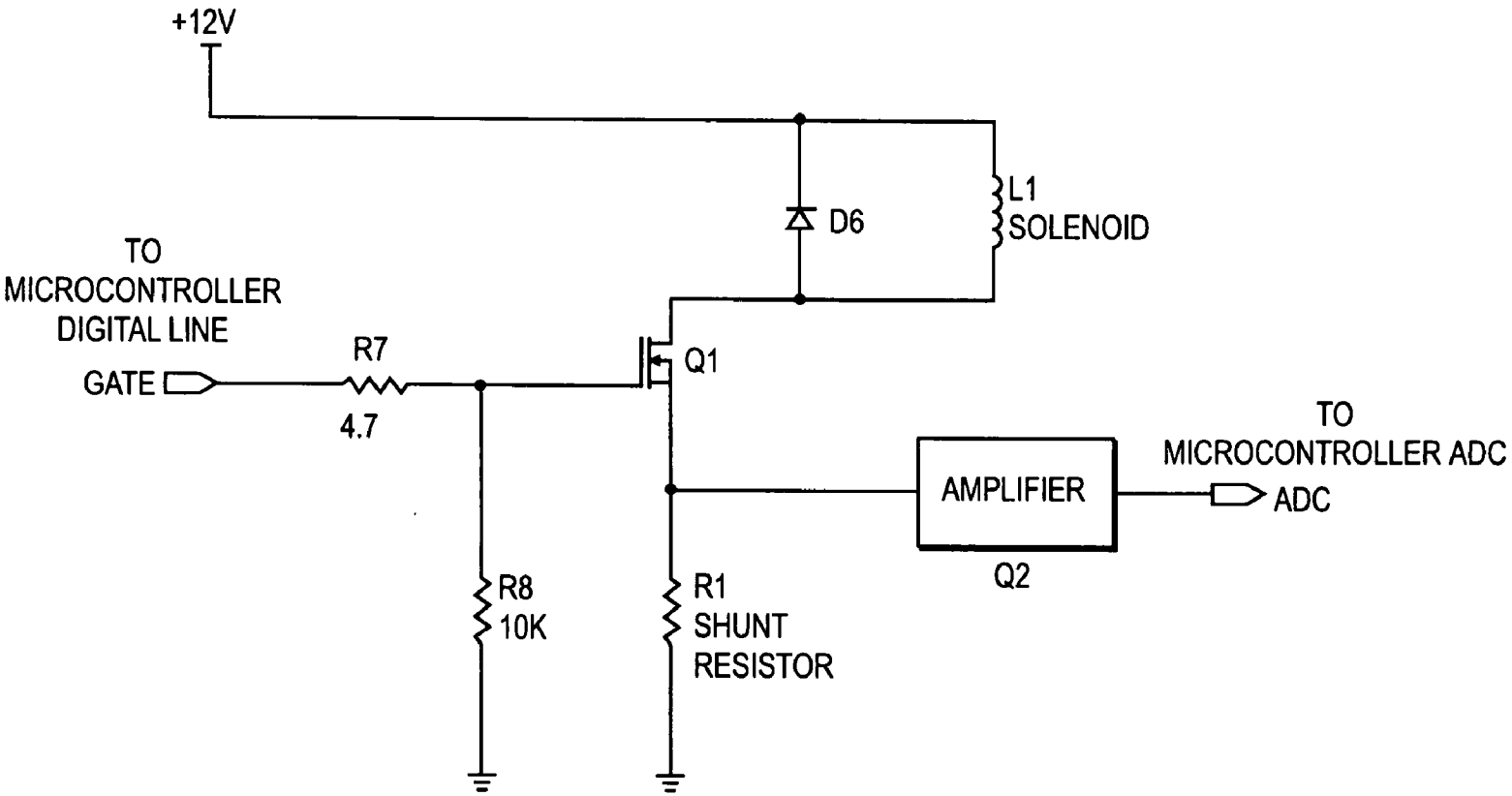
FIG. 9 is a schematic diagram of electronic components to drive the solenoid to both stop the steering mechanism and to vary steering effort.

FIG. 9 shows a schematic diagram of the electronic components to engage the stop mechanism either fully on or partially on for steering effort adjustment. The microcontroller applies a digital signal to the gate. To fully engage the stop mechanism, an active high logic applies the gate. To partially apply the stop mechanism, a pulse width modulation signal applies the gate. In turn, the battery voltage is supplied to the coil L1 of the stop mechanism.

An example of the detail circuitry is illustrated. Resistor R7 is a speed control resistor to control the ON timing of the MOSFET Q1. Resistor R8 is a pulldown resistor to normally turn off MOSFET Q1. Diode D6 acts as a fly-back diode to reduce the induction kick from the coil. Shunt resistor R1 is an example to sense the current going through the coil to 1) act as a feedback signal for variable steering effort; 2) to compensate temperature effect of the coil. Amplifier Q2, in this example an op-amp, amplifies the voltage across the shunt resistor. The amplified voltage is fed to the analog to digital converter in the microcontroller. It should be understood that there are many different electronic circuits to achieve the same purpose of driving the stop mechanism.

Figure 5:
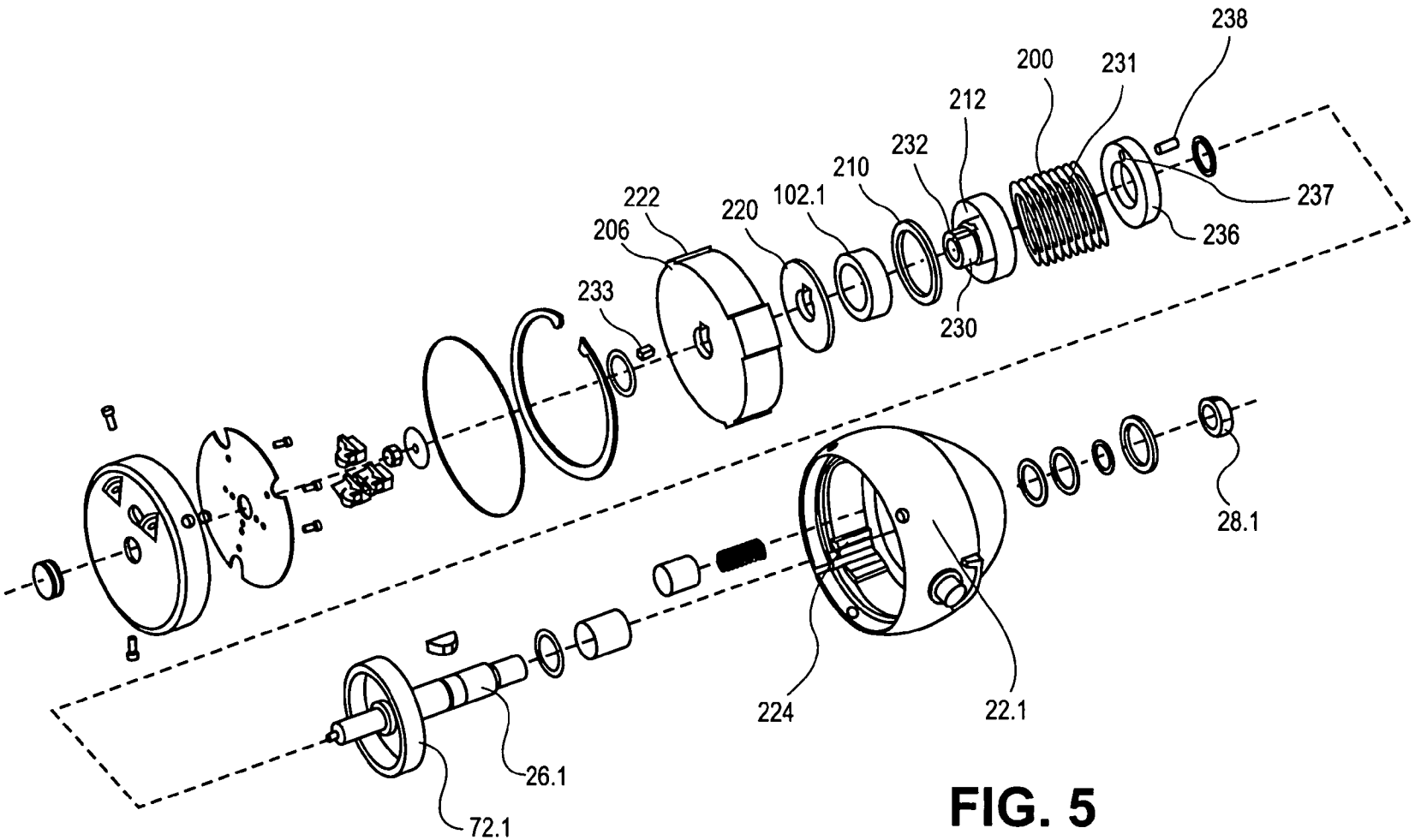
FIG. 5 is an exploded view of another helm apparatus according to a second embodiment of the invention.
Figure 6A:
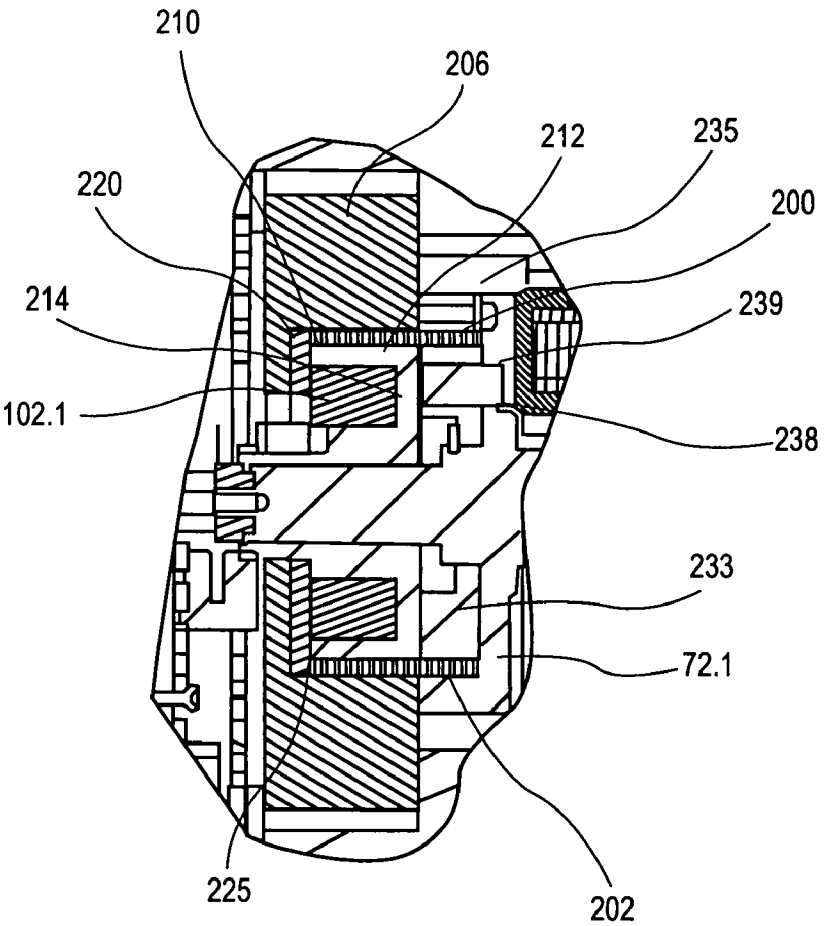
FIG. 6*a* is an enlarged, sectional view of the stop mechanism thereof.
Figure 6:
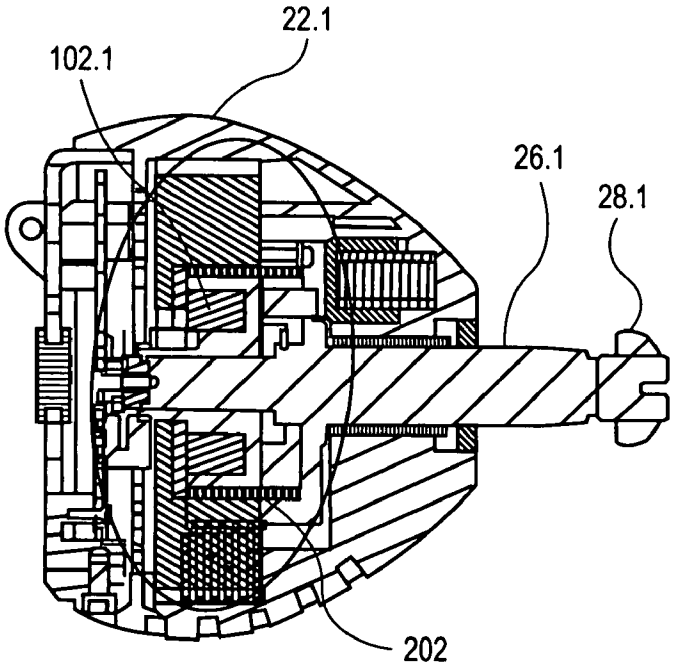
FIG. 6 is a sectional view thereof.

A further variation of the invention is shown in FIGS. 5 and 6. Overall this embodiment is similar to the ones described above and accordingly is described only in relation to the differences therebetween. Like numbers identify like parts with the additional designation "0.1". In this embodiment, in place of the multi-plate clutch, there is a helical spring 200. The spring is received in an annular slot 202 located between members 210, 212 and 236 on the inside and members 206 and 72.1 on the outside. Solenoid 102.1 is located within annular groove 214 of the member 212 as well as being within the annular member 210. On the side opposite member 210 is located a washer-like member 220.

The member 206 has a series of external projections 222, four in this example, which fit within slots 224 of the housing. Thus it may be seen that the member 206 is non-rotatable with respect to the housing. The member 212 has a shaft like projection 230 with a keyway 232 keyed onto members 220 and 206 by key 233 so all the members 206, 220 and 212 are non-rotatable with respect to the housing. In this example the member 206 and the member 210 are of a non-ferromagnetic material, aluminum in this particular case. The members 220 and 212 are of a ferromagnetic material, steel in this particular example. Thus, as may be seen in FIG. 6, a solenoid 102.1 is essentially surrounded by ferromagnetic materials which, in turn, are surrounded by non-ferromagnetic materials which confines the magnetic field to a loop formed by the member 212, 102.1 and 220, apart from a relatively small gap 224 which concentrates the magnetic field across the gap.

The coil spring 200 has a projection 231 received within slot 235 of member 72.1 of the steering shaft 26.1. Pin 238 mounted in bore 237 in member 236 and in bore 239 in member 72.1 holds member 236 non-rotatable with respect to member 72.1. Thus the spring rotates with the shaft and the steering wheel. When the solenoid is energized, the gap 225 is closed and the spring contacts the member 220 which is connected to the housing. The friction between spring 200 and member 220 winds the spring. Depending upon the direction of rotation of the steering wheel, the spring expands or contracts. When it contracts, it winds against the inner annular surface on members 210, 212 and 236. When it expands, it winds against the outer annular surfaces on members 206 and 72.1. In both cases, there is a braking action which prevents further rotation of the steering shaft and steering wheel. Thus, a single mechanism, and in particular a single helical spring, acts as a stop device for both directions of rotation of the steering wheel. It is understood that other spring attachments can be arranged.

In alternative embodiments the invention could also be adapted for other types of vehicles besides marine craft. In such cases another steerable members such as a wheel all or wheels would be substituted for the rudder.

Although this invention is described in relation to a marine steering system, it should be understood that the invention is also applicable to other types of steering systems such as steering systems for tractors and automobiles.

What is claimed is:

1. A helm apparatus for a marine craft having a rudder, comprising:

a mechanically rotatable steering device;

a sensor which senses angular movement of the steering device when the craft is steered;

a stop mechanism actuated when the rudder reaches a starboard or port hard-over threshold position, near a starboard or port hard-over position, causing the stop mechanism to engage the steering device to stop further rotation of the steering device in a first rotational direction, corresponding to rotational movement towards said hard-over position, rotational play being provided between the steering device and the stop mechanism, whereby the steering device can be rotated a limited amount, as sensed by the sensor, when the stop mechanism is fully engaged, the stop mechanism being released from engagement with the steering device when the sensor senses that the steering device is rotated, as permitted by said play, in a second rotational direction which is opposite the first rotational direction.

2. The apparatus as claimed in claim 1 wherein the helm apparatus includes a processor which permits the stop mechanism to release when the stop mechanism is fully engaged and the steering device is rotated in the second rotational direction.

3. The apparatus as claimed in claim 2, including multiple sensors to sense angular rotation of the steering shaft.

4. The apparatus as claimed in claim 2, wherein the stop mechanism includes a multi-plate clutch, the clutch having a plurality of plates which are urged into frictional engagement with each other by an electromagnetic actuator to engage the steering device.

5. The apparatus as claimed in claim 1, wherein the stop mechanism includes an electromagnetic actuator, the electromagnetic actuator releasing the steering device when the steering device is rotated in the second rotational direction while the stop mechanism is engaged.

6. The apparatus as claimed in claim 5 wherein the stop mechanism includes a multi-plate clutch, the clutch having a plurality of plates which are urged into frictional engagement with each other by the electromagnetic actuator to engage the steering device.

7. The apparatus as claimed in claim 6, including a housing having a hollow interior, the stop mechanism, the sensor and the processor being within the housing, one of the interior of the housing and at least some of the plates of the clutch having slots and another of the interior of the housing and at least some of the said plates having projections fitting within the slots, the slots being wider than the projections to provide said play between the sensor and the stop mechanism.

8. The apparatus as claimed in claim 6, including means for controlling the actuator to partially apply the stop mechanism to provide steering effort.

9. The apparatus as claimed in claim 8, wherein the means adjustably controls the actuator to provide variable steering effort.

10. The apparatus as claimed in claim 9, wherein the means determines a solenoid gap by measuring inductance change, for feedback control of the variable steering effort.

11. The apparatus as claimed in claim 9, wherein the means includes a proximity sensor to determine a solenoid gap for feedback control of the variable steering effort.

12. The apparatus as claimed in claim 9, wherein the means uses pulse width modulation.

13. The apparatus as claimed in claim 8, wherein the means uses pulse width modulation.

14. The apparatus as claimed in claim 5, wherein the stop mechanism includes a member having an annular slot bounded radially outwardly by an outer annular surface and inwardly by an inner annular surface, a helical spring being located in said annular slot, said spring engaging said outer annular surface when the electromagnetic actuator is actuated while the steering device is being rotated in one rotational direction and said spring engaging said inner annular surface when the electromagnetic actuator is actuated while the steering device is being rotated in another said rotational direction.

15. The apparatus as claimed in claim 1, wherein the steering device includes a steering shaft, the sensor senses angular movement of the shaft and the stop mechanism engages the shaft.

16. The apparatus as claimed in claim 1, wherein the stop mechanism is bidirectional.

17. A steering apparatus for a marine craft having a rudder, comprising:

a rotatable wheel;

an encoder responsive to angular movement of the wheel which provides helm signals indicative of incremental movement of the wheel;

a stop mechanism capable of selectively stopping rotation of the wheel;

a processor adjacent to the stop mechanism and coupled to the encoder which receives the helm signals and rudder signals indicative of positions of the rudder, the processor providing a stop signal to actuate the stop mechanism and stop rotation of the wheel when the rudder approaches, within a predetermined amount, a predetermined limit of travel, wherein the processor has a memory which retains positions of the helm.

18. The steering apparatus as claimed in claim 17, wherein the processor is integral with the stop mechanism.

19. The steering system as claimed in claim 17, wherein the processor permits the stop mechanism to release when the wheel is steered in a direction which would move the rudder away from said predetermined limit of travel.

20. The steering system as claimed in claim 19, wherein the processor provides a signal to reengage the stop mechanism when the steering wheel is steered in a direction which would move the rudder back towards said predetermined limit of travel after the stop mechanism is released.

21. The steering system as claimed in claim 20, wherein the processor provides a signal to reengage the stop mechanism only when the steering wheel is steered back further in the direction which would move the rudder towards said predetermined limit of travel, after the stop mechanism is released, than the wheel was previously steered in the direction which would move the rudder away from said predetermined limit of travel.

22. The steering system as claimed in claim 20, wherein the processor provides a signal to reengage the stop mechanism only when the steering wheel has, in aggregate, been steered back further in the direction which would move the rudder towards said predetermined limit of travel, after the stop mechanism is released, than the wheel has, in aggregate, been steered in the direction which would move the rudder away from said predetermined limit of travel.

23. The steering system as claimed in claim 17, wherein the apparatus includes a housing, the encoder, the stop mechanism and the processor being within the housing.

24. A method of stopping rotation of a steering wheel of a vessel having a rudder and hard-over positions of the rudder, the method comprising:

producing rudder signals indicating rudder positions;

receiving the rudder positions near the steering wheel;

determining, utilizing a processor adjacent to the wheel, whether the rudder positions are within a predetermined distance of a hard-over position of the rudder;

engaging a stop mechanism operatively coupled to the steering wheel if the steering wheel is rotated in a direction corresponding to rudder movement towards said hard-over position;

releasing the stop mechanism if the steering wheel is rotated in a direction corresponding to rudder movement away from said hard-over position, wherein the stop mechanism is reengaged if the wheel is steered back in a rotational direction corresponding to rudder movement towards the hard-over position and wherein the stop mechanism is reengaged only when the steering wheel is steered further in the direction which would move the rudder towards said hard-over position, after the stop mechanism is released, than the wheel was previously steered in the direction which would move the rudder away from said hard-over position.

25. The method as claimed in claim 24, wherein the stop mechanism is reengaged only when the steering wheel has, in aggregate, been steered further in the direction which would move the rudder towards said hard-over position, after the stop mechanism is released, than the wheel has, in aggregate, been steered in the direction which would move the rudder away from said hard-over position.

26. The method as claimed in claim 24, wherein decisions to engage or disengage the wheel are made by a processor adjacent to the steering wheel.

27. The method as claimed in claim 24, wherein the position of the rudder is retained in memory adjacent to the steering wheel.

28. A steering apparatus for a vehicle having a steered member, comprising:

a mechanically rotatable steering device;

a sensor which senses angular movement of the steering device when the vehicle is steered;

a stop mechanism actuated when the steered member reaches a first or second threshold position, near a first or second hard-over position, causing the stop mechanism to engage the steering device to stop further rotation of the steering device in a first rotational direction, corresponding to rotational movement towards said hard-over position, rotational play being provided between the steering device and the stop mechanism, whereby the steering device can be rotated a limited amount, as sensed by the sensor, when the stop mechanism is fully engaged, the stop mechanism being released from engagement with the steering device when the sensor senses that the steering device is rotated, as permitted by said play, in a second rotational direction which is opposite the first rotational direction.

29. The apparatus as claimed in claim 28 wherein the steering apparatus includes a processor which permits the stop mechanism to release when the stop mechanism is fully engaged and the steering device is rotated in the second rotational direction.

30. The apparatus as claimed in claim 29, including multiple sensors to sense angular rotation of the steering shaft.

31. The apparatus as claimed in claim 29, wherein the stop mechanism includes a multi-plate clutch, the clutch having a plurality of plates which are urged into frictional engagement with each other by an electromagnetic actuator to engage the steering device.

32. The apparatus as claimed in claim 28, wherein the stop mechanism includes an electromagnetic actuator, the electromagnetic actuator releasing the steering device when the steering device is rotated in the second rotational direction while the stop mechanism is engaged.

33. The apparatus as claimed in claim 32 wherein the stop mechanism includes a multi-plate clutch, the clutch having a plurality of plates which are urged into frictional engagement with each other by the electromagnetic actuator to engage the steering device.

34. The apparatus as claimed in claim 33, including a housing having a hollow interior, the stop mechanism, the sensor and the processor being within the housing, one of the interior of the housing and at least some of the plates of the clutch having slots and another of the interior of the housing and at least some of the said plates having projections fitting within the slots, the slots being wider than the projections to provide said play between the sensor and the stop mechanism.

35. The apparatus as claimed in claim 33, including means for controlling the actuator to partially apply the stop mechanism to provide steering effort.

36. The apparatus as claimed in claim 35, wherein the means adjustably controls the actuator to provide variable steering effort.

37. The apparatus as claimed in claim 36, wherein the means determines a solenoid gap by measuring inductance change, for feedback control of the variable steering effort.

38. The apparatus as claimed in claim 36, wherein the means includes a proximity sensor to determine a solenoid gap for feedback control of the variable steering effort.

39. The apparatus as claimed in claim 36, wherein the means uses pulse width modulation.

40. The apparatus as claimed in claim 35, wherein the means uses pulse width modulation.

41. The apparatus as claimed in claim 32, wherein the stop mechanism includes a member having an annular slot bounded radially outwardly by an outer annular surface and inwardly by an inner annular surface, a helical spring being located in said annular slot, said spring engaging said outer annular surface when the electromagnetic actuator is actuated while the steering device is being rotated in one rotational direction and said spring engaging said inner annular surface when the electromagnetic actuator is actuated while the steering device is being rotated in another said rotational direction.

42. The apparatus as claimed in claim 28, wherein the steering device includes a steering shaft, the sensor senses angular movement of the shaft and the stop mechanism engages the shaft.

43. The apparatus as claimed in claim 28, wherein the stop mechanism is bidirectional.

44. A steering apparatus for a marine vehicle having a steered member, comprising:

a rotatable wheel;

an encoder responsive to angular movement of the wheel which provides steering signals indicative of incremental movement of the wheel;

a stop mechanism capable of selectively stopping rotation of the wheel;

a processor adjacent to the stop mechanism and coupled to the encoder which receives the steering signals and steered member signals indicative of positions of the steered member, the processor providing a stop signal to actuate the stop mechanism and stop rotation of the wheel when the steered member approaches, within a predetermined amount, a predetermined limit of travel, wherein the processor is integral with the stop mechanism and wherein the processor has a memory which retains positions of the steering.

45. The steering system as claimed in claim 44, wherein the processor permits the stop mechanism to release when the wheel is steered in a direction which would move the steered member away from said predetermined limit of travel.

46. The steering system as claimed in claim 45, wherein the processor provides a signal to reengage the stop mechanism when the steering wheel is steered in a direction which would move the steered member back towards said predetermined limit of travel after the stop mechanism is released.

47. The steering system as claimed in claim 46, wherein the processor provides a signal to reengage the stop mechanism only when the steering wheel is steered back further in the direction which would move the steered member towards said predetermined limit of travel, after the stop mechanism is released, than the wheel was previously steered in the direction which would move the steered member away from said predetermined limit of travel.

48. The steering system as claimed in claim 46, wherein the processor provides a signal to reengage the stop mechanism only when the steering wheel has, in aggregate, been steered back further in the direction which would move the steered member towards said predetermined limit of travel, after the stop mechanism is released, than the wheel has, in aggregate, been steered in the direction which would move the steered member away from said predetermined limit of travel.

49. The steering system as claimed in claim 44, wherein the apparatus includes a housing, the encoder, the stop mechanism and the processor being within the housing.

50. A method of stopping rotation of a steering wheel of a vessel having a steered member and hard-over positions of the steered member, the method comprising:

producing steered member signals indicating steered member positions;

receiving the steered member positions near the steering wheel;

determining, utilizing a processor adjacent to the wheel, whether the steered member positions are within a predetermined distance of a hard-over position of the steered member;

engaging a stop mechanism operatively coupled to the steering wheel if the steering wheel is rotated in a direction corresponding to steered member movement towards said hard-over position;

releasing the stop mechanism if the steering wheel is rotated in a direction corresponding to steered member movement away from said hard-over position, wherein the stop mechanism is reengaged if the wheel is steered back in a rotational direction corresponding to steered member movement towards the hard-over position and wherein the stop mechanism is reengaged only when the steering wheel is steered further in the direction which would move the steered member towards said hard-over position, after the stop mechanism is released, than the wheel was previously steered in the direction which would move the steered member away from said hard-over position.

51. The method as claimed in claim 50, wherein the stop mechanism is reengaged only when the steering wheel has, in aggregate, been steered further in the direction which would move the steered member towards said hard-over position, after the stop mechanism is released, than the wheel has, in aggregate, been steered in the direction which would move the steered member away from said hard-over position.

52. The method as claimed in claim 50, wherein decisions to engage or disengage the wheel are made by a processor adjacent to the steering wheel.

53. The method as claimed in claim 50, wherein the position of the steered member is retained in memory adjacent to the steering wheel.

* * * * *